US008398333B2

(12) United States Patent
Cureton

(10) Patent No.: US 8,398,333 B2
(45) Date of Patent: Mar. 19, 2013

(54) EXPANSION JOINT HOLDER

(76) Inventor: Don L. Cureton, Independence, MO (US)

( * ) Notice: Subject to any disclaimer, the term of this patent is extended or adjusted under 35 U.S.C. 154(b) by 0 days.

(21) Appl. No.: 13/249,782

(22) Filed: Sep. 30, 2011

(65) Prior Publication Data

US 2012/0082512 A1 Apr. 5, 2012

Related U.S. Application Data

(60) Provisional application No. 61/389,005, filed on Oct. 1, 2010.

(51) Int. Cl.
*E01C 23/02* (2006.01)

(52) U.S. Cl. ..... 404/87; 404/83; 15/235.4

(58) Field of Classification Search ..... 404/87, 404/100; 15/235.4
See application file for complete search history.

(56) References Cited

U.S. PATENT DOCUMENTS

| | | | | |
|---|---|---|---|---|
| 1,629,544 | A * | 5/1927 | Shaw | 249/3 |
| 1,969,884 | A * | 8/1934 | Heltzel | 404/87 |
| 4,936,704 | A * | 6/1990 | Killmeyer | 404/74 |
| 6,775,952 | B2 * | 8/2004 | Boxall et al. | 52/396.05 |
| 2005/0155164 | A1 * | 7/2005 | Wojtaszek | 14/73.1 |
| 2007/0061989 | A1 * | 3/2007 | Kalbach | 15/235.8 |

* cited by examiner

*Primary Examiner* — Raymond W Addie
(74) *Attorney, Agent, or Firm* — Erickson Kernell Derusseau & Kleypas, LLC

(57) ABSTRACT

An expansion joint holder on an existing slab of concrete employs teeth that releasably grip and hold an expansion joint when an adjoining slab is poured, and is provided with an upstanding handle for installation and subsequent removal after the adjoining slab has been poured or placed against the expansion joint.

4 Claims, 2 Drawing Sheets

EXPANSION JOINT HOLDER

CROSS REFERENCE TO RELATED APPLICATION

This application claims the benefit of a prior filed, provisional application No. 61/389,005, filed Oct. 1, 2010, entitled EXPANSION JOINT HOLDER.

FIELD OF THE INVENTION

This invention relates to the installation of expansion joints to absorb the expansion and contraction of sections of concrete slabs utilized in the construction of sidewalks, streets and walkways, and other structures constructed of concrete, and which are subject to expansion and contraction due to warming and cooling through seasonal variation or due to other heat sources.

BACKGROUND OF THE INVENTION

Expansion joints are widely used in construction to absorb vibration or to allow movement due to ground settlement, earthquakes or the normal warming and cooling caused by seasonal variation. Typically, a concrete walkway or road comprises a series of slabs poured in side-by-side or end-to-end relationship. Initially, the slabs are separately poured in spaced relationship to present a first slab spaced from a second slab to present an unpoured section between each successive pair of cured slabs. Once the initially poured series of spaced sections have set, expansion joints are added and the remaining sections are poured to provide a continuous walkway or roadway.

As is conventional, expansion joints are provided between each pair of adjacent slab sections and may comprise a variety of different types of materials, such as recycled rubber from tires, a fibrous material such as wood, or other types of material capable of presenting an expansion joint that will expand and contract as the slabs expand and contract in response to temperature changes, or due to movement along a roadway for example such as a road or a bridge. Various materials, such as strips of recycled rubber may provide an expansion joint between adjacent sections to compensate for expansion of the adjacent slabs. However, expansion joints installed at the time that the concrete is poured must be held in place against the previously poured slab until the unpoured section is partially filled, often requiring that a workman at the site physically hold a strip of material such as recycled rubber against the edge of the existing, cured slab until concrete fills the adjacent unpoured section sufficiently to hold the expansion joint in place. This subjects the worker to possible back or knee injury or injury to the eyes due to significant time of exposure in close proximity to the hot, poured concrete.

SUMMARY OF THE INVENTION

In an embodiment of the present invention the aforementioned problem is addressed by providing an expansion joint holder which is installed on the exposed edge of the existing slab and may be left in place without the attendance of a workman, and thereafter removed once the adjacent, unpoured section is filled with concrete and holds the expansion joint in place. The holder employs teeth that releasably grip the expansion joint, and is provided with an upstanding handle so that the holder is easily installed and subsequently removed once the poured concrete is sufficiently set.

Other advantages of this invention will become apparent from the following description taken in connection with the accompanying drawings, wherein is set forth by way of illustration and example, an embodiment of the present invention.

DETAILED DESCRIPTION

Figure 1:
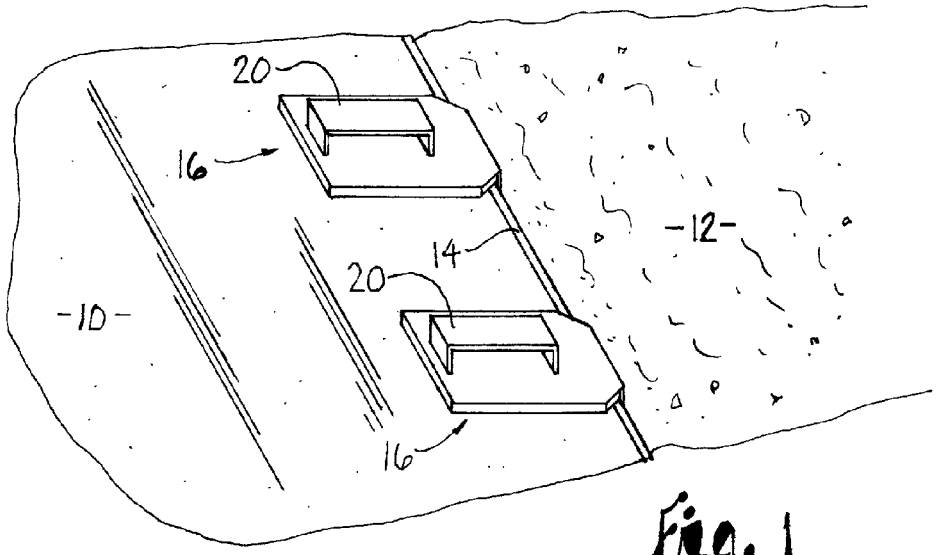
FIG. 1 is a perspective view looking downwardly on adjoining existing and freshly poured sections of a concrete roadway, showing the existing section on the left and the recently poured section on the right, and four joint holders of the present invention spaced along the expansion joint between the two sections.
Figure 2:
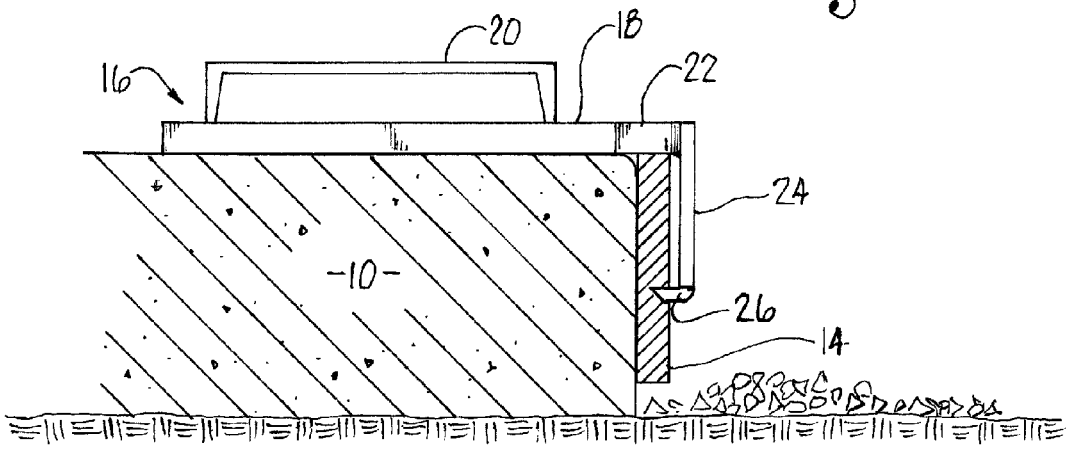
FIG. 2 is a cross sectional view of an existing concrete slab showing the joint holder in place engaging and holding an expansion joint.
Figure 3:
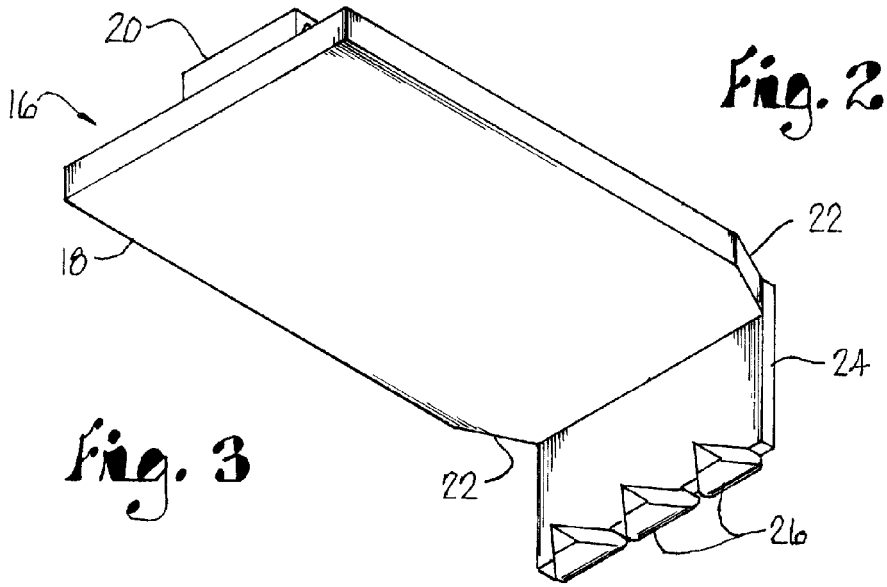
FIG. 3 is a perspective view of the joint holder of FIG. 2 from beneath, showing the teeth that engage the expansion joint.

Referring initially to FIGS. 1-3, a portion of an existing slab 10 of a concrete roadway is shown on the left abutting a recently formed slab section 12 on the right, the two slab sections being spaced from each other by an expansion joint 14 that may, for example, comprise a strip of recycled rubber that extends downwardly (as seen in FIG. 2) along a substantial portion of the thickness of the slab 10 (FIG. 2). For clarity, the joining slab 12 is not shown in FIG. 2. Slab 12 is recently poured and has not as yet set. Two joint holders 16 of the present invention are shown spaced along the edge of slab 10 in FIG. 1, it being appreciated that the number of holders 10 employed and their spacing would be determined by the width of the concrete roadway or other concrete slab structure.

Figure 4:
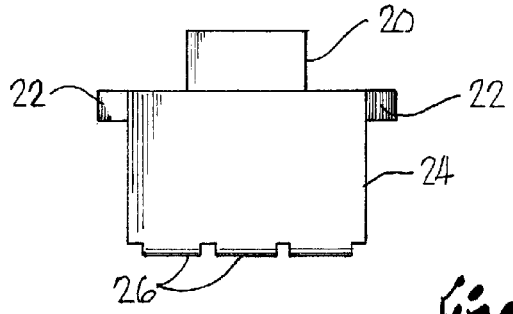
FIG. 4 is a right end view of the joint holder of FIGS. 2 and 3.

More particularly, with reference to FIGS. 2-4, each of the joint holders 16 comprises a metal baseplate 18 having an upstanding handle 20 welded thereto, and tapered corners 22 presenting the right end of holder 16 as viewed in FIGS. 1-3. An endplate 24 (preferably steel) is welded or otherwise secured to the tapered end of joint holder 16, depends therefrom and has three spaced teeth 26 along the bottom edge of endplate 24 each of which is tapered to a point in order to readily pierce the expansion joint 14 as shown in FIG. 2.

Figure 5:
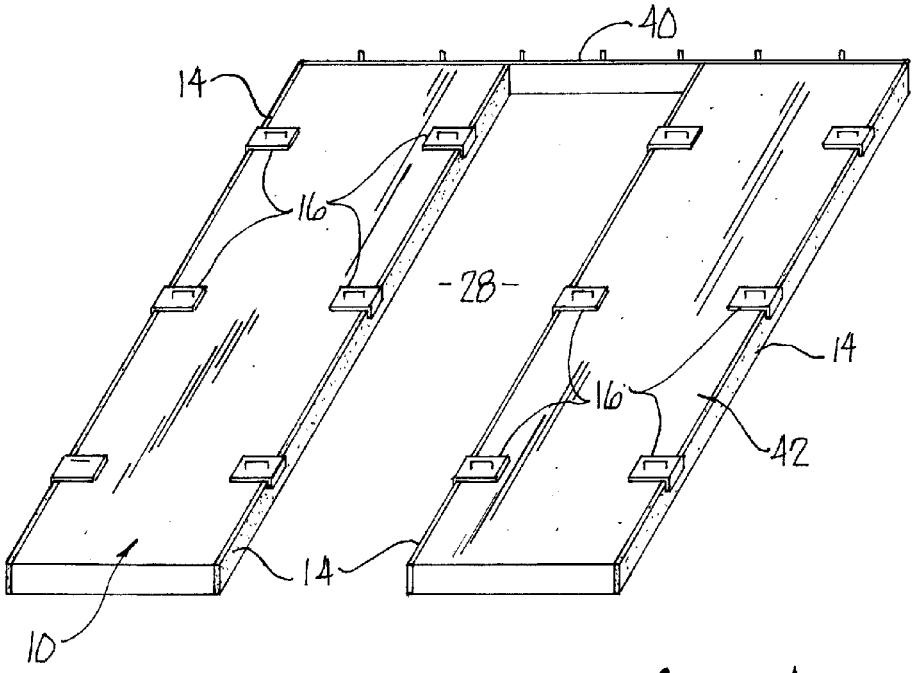
FIG. 5 is a perspective view showing existing slabs and an unpoured section therebetween, and expansion joint holders in place at the expansion joint.

It may be appreciated that the joint holder 16 may be readily grasped by the handle 20 and placed on the slab in engagement with expansion joint 14 by grasping the handle 20 and installing the joint holder 16 by inserting the depending endplate 24 into the unpoured section of concrete 12, and then manually shifting the joint holder 16 to the left (as viewed in FIGS. 1 and 2) to embed the pointed teeth 26 in the expansion joint 14. This is accomplished by a workman on the slab 10 at the outset of pouring concrete into the unpoured section as illustrated in FIG. 5. Accordingly, utilizing the expansion joint holders 16 of the present invention, a workman can secure the expansion joint 14 prior to pouring concrete into the unpoured section as illustrated in FIG. 5.

Referring to FIG. 5, it is apparent that a workman need not be present and exposed to the uncured concrete when it is poured into an unpoured section 28 as the joint holders 16 hold the expansion joint in place. FIG. 5 illustrates a bulkhead

40 and a second existing slab 42 spaced from existing slab 10 and presenting the unpoured center section 28. Accordingly, there is no exposure to injury while the center section in FIG. 5 is being poured. Once the concrete has set sufficiently to hold the expansion joint 14 in place, the holders 16 are removed and may be reused repeatedly as successive sections of a roadway, for example, are poured.

It should be understood that while certain forms of this invention have been illustrated and described, it is not limited thereto except insofar as such limitations are included in the following claims.

Having thus described the invention, what is claimed as new and desired to be secured by Letters Patent is as follows:

1. An expansion joint holder comprising:

a baseplate adapted to overlie an existing section of concrete and having an upstanding handle thereon to permit the baseplate to be placed on the existing section of concrete; and an endplate depending from said baseplate and provided with means including an inwardly projecting tooth for engaging an expansion joint separating said existing section from abutting uncured concrete to hold the expansion joint until the uncured concrete is set sufficiently to maintain the expansion joint in place, whereby the expansion joint holder may then be removed and reused as successive sections are poured.

2. The expansion joint holder as claimed in claim 1, wherein said tooth is adapted to penetrate said expansion joint and secure it at a desired position.

3. The expansion joint holder as claimed in claim 1, wherein said means for engaging the expansion joint includes a plurality of spaced, inwardly projecting teeth adapted to penetrate said expansion joint and secure it at a desired position.

4. The expansion joint holder as claimed in claim 3, wherein said teeth on the endplate are spaced beneath said baseplate and present a row thereof for engaging said expansion joint.

* * * * *